US008193458B2

(12) United States Patent
Hozumi et al.

(10) Patent No.: US 8,193,458 B2
(45) Date of Patent: Jun. 5, 2012

(54) ELECTRIC TOOL SWITCH

(75) Inventors: Akihiro Hozumi, Takatsuki (JP); Koji Omori, Kusatsu (JP)

(73) Assignee: OMRON Corporation, Kyoto (JP)

( * ) Notice: Subject to any disclaimer, the term of this patent is extended or adjusted under 35 U.S.C. 154(b) by 310 days.

(21) Appl. No.: 12/639,535

(22) Filed: Dec. 16, 2009

(65) Prior Publication Data

US 2010/0163384 A1 Jul. 1, 2010

(30) Foreign Application Priority Data

Dec. 26, 2008 (JP) ..... 2008-333666

(51) Int. Cl.
*H01H 9/06* (2006.01)
*H01H 19/20* (2006.01)

(52) U.S. Cl. ..... 200/1 V; 200/332.2; 200/11 DA; 200/567

(58) Field of Classification Search ..... 200/4, 11 R, 200/14, 11 A–11 TW, 1 V, 61.85, 564–567, 200/570, 571, 330–332.2, 336; 173/20, 29, 173/78, 216, 217, 171
See application file for complete search history.

(56) References Cited

U.S. PATENT DOCUMENTS 4,581,499 A * 4/1986 Cousins ..... 200/1 V
4,772,765 A * 9/1988 Markle et al. ..... 200/1 V
4,822,958 A * 4/1989 Van Laere ..... 200/1 V
4,894,492 A * 1/1990 Palumbo ..... 200/1 V
5,089,729 A * 2/1992 Moores, Jr. ..... 310/50
5,170,851 A * 12/1992 Kress et al. ..... 173/29
6,199,642 B1 * 3/2001 Becker et al. ..... 173/217
2009/0057123 A1 * 3/2009 Yoshikawa ..... 200/567
2011/0031098 A1 * 2/2011 Nagasaka et al. ..... 200/336
2011/0032058 A1 * 2/2011 Hoess et al. ..... 335/154

FOREIGN PATENT DOCUMENTS

JP 3768400 B2 4/2006

OTHER PUBLICATIONS

English abstract for Japanese Patent No. 3768400, publication date Apr. 19, 2006 (1 page).

* cited by examiner

*Primary Examiner* — Michael Friedhofer
(74) *Attorney, Agent, or Firm* — Osha • Liang LLP

(57) ABSTRACT

An electric tool switch has an operation member turnable in both directions and biased to self-return to a neutral position, a circuit substrate arranged to be orthogonal to a turning shaft of the operation member, a slidably moving element which is pressed against the circuit substrate and which is turned with the operation member to slidably contact the circuit substrate, and an inversion mechanism for switching a polarity between output terminals according to the turning direction of the operation member from the neutral position. The circuit substrate is formed with two sets of variable resistor circuits, which close a circuit when the slidably moving element slidably contacts and which resistance value changes according to a contacting position of the slidably moving element, electrically connected in parallel on both sides in the turning direction from a position corresponding to the neutral position of the operation member.

5 Claims, 12 Drawing Sheets

ELECTRIC TOOL SWITCH

BACKGROUND OF THE INVENTION

1. Technical Field

The present invention relates to an electric tool switch.

2. Related Art

A trigger switch including a trigger pulled towards a grip of an electric tool is conventionally used as a switch having a speed adjustment function for the electric tool. The trigger switch is interposed between a battery and a motor, and adjusts the rotating speed of the motor by outputting a voltage of a current-flow ratio corresponding to the pulled amount of the trigger.

The trigger switch normally includes a variable resistor in which a slidably moving element that moves with the trigger slidably contacts a print resistor formed on a circuit substrate, and adjusts the output to the motor by changing the conduction time ratio of the switching element by changing the resistance value of the variable resistor according to the pulled amount of the trigger.

The trigger switch enabling the motor to be rotated in a reverse direction includes a switching switch for inverting a polarity of the output. Japanese Patent No. 3768400 describes an invention in which two circuits, in which the resistance value changes differently according to the pulled amount of the trigger, are arranged in parallel to cause the rotating speed of the motor with respect to the pulled amount of the trigger to differ at the time of forward rotation and at the time of reverse rotation of the motor, and only one of the circuits is connected by the switching switch for inverting the polarity of the output.

When using the electric tool that uses the trigger switch, the user sensuously grasps the pulled amount of the trigger, but subtle difference in the pulled amount is difficult to recognize and only a rough speed control can be carried out.

The task is sometimes interrupted when the tool is switched from one hand to the other or the hand is released from the work to operate the switching switch.

SUMMARY

One or more embodiments of the present invention provides an electric tool switch enabling fine speed control of an electric tool by an intuitive operation.

An electric tool switch according to one or more embodiments of the present invention includes: an operation member turnable in both directions and biased to self-return to a neutral position; a circuit substrate arranged to be orthogonal to a turning shaft of the operation member; a slidably moving element which is pressed against the circuit substrate and which is turned with the operation member to slidably contact the circuit substrate; and an inversion mechanism for switching a polarity between output terminals according to the turning direction of the operation member from the neutral position; wherein the circuit substrate is formed with two sets of variable resistor circuits, which close a circuit when the slidably moving element slidably contacts and which resistance value changes according to a contacting position of the slidably moving element, electrically connected in parallel on both sides in the turning direction from a position corresponding to the neutral position of the operation member.

According to such a configuration, since a user turns the operation member, the user can easily intuitively grasp an operation amount and can finely adjust an output according to the operation amount. As the rotating direction of the tool changes depending on the turning direction of the operation member, extra switch operation for reversing the rotating direction of the tool is unnecessary, and the task can be continuously carried out.

In the electric tool switch according to one or more embodiments of the present invention, a change in resistance value with respect to a turning angle of the operation member of two sets of variable resistor circuits may be different from each other.

According to such a configuration, the speed change properties are differed for the forward rotation and the reverse rotation of the tool, and the speed change properties that enable the tool to be most easily handled in the respective rotating direction are provided.

In the electric tool switch according to one or more embodiments of the present invention, the inversion mechanism may switch the polarity at a position shifted from the neutral position, and short-circuit the output terminals at the neutral position.

According to such a configuration, the function of a short-circuit brake for stopping the rotation of the motor by inertia can be realized by short-circuiting the terminals of the motor at the neutral position.

In the electric tool switch according to one or more embodiments of the present invention, the operation member may be formed to a substantially cylindrical shape and may be operably arranged at an outer periphery of a switch main body fixed to an electric tool.

According to such a configuration, operability enabling the user to intuitively grasp the operation amount as if turning the dial can be provided by realizing a substantially cylindrical outer shape. The switch does not become long in the turning shaft direction by arranging other components inside the operation member.

An electric tool switch according to one or more embodiments of the present invention may include: an acting portion, which turns about the turning shaft with the operation member inside the switch main body; a lock portion which projects inward from an inner wall of the switch main body; and a bias spring, having a central part held at a periphery of the turning shaft and both ends extending to sandwich the acting portion and the lock portion, for turning and biasing so as to have the acting portion in series with the lock portion and the turning shaft.

According to such a configuration, sufficient turning angle of the operation member can be ensured without affecting the strength of the switch main body since the bias spring does not pass through the switch main body.

According to one or more embodiments of the present invention, the user can intuitively grasp the rotating direction and the rotating speed of the tool and perform a fine control since the tool such as a drill can be rotated according to the turning direction and the turning angle of the turnable operation member.

DETAILED DESCRIPTION

Figure 1:
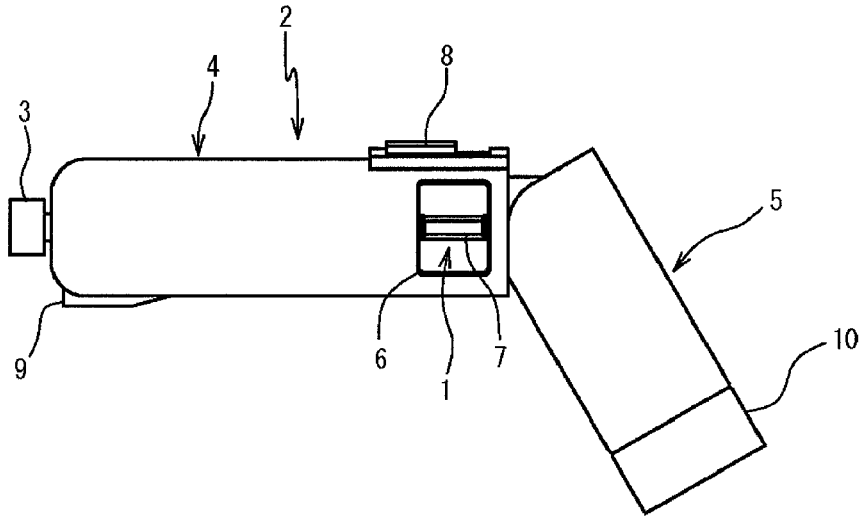
FIG. 1 is a side view of an electric tool including a switch according to a first embodiment of the present invention.

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. Hereinafter, preferred embodiments of the present invention will be described with reference to the drawings. FIG. 1 shows an electric tool 2 including a switch 1 according to one embodiment of the present invention. The electric tool 2 has a rotatable chuck 3, which grips a distal end tool such as a drill, a driver bit, and a grinder bit at a distal end, and includes a tool main body 4, having a substantially cylindrical shape substantially coaxial with a rotation shaft of the chuck 3 and incorporating the switch 1, and a grip 5, extending diagonally backward to a lower side from the back end of the tool main body 4, to be gripped by a user.

The switch 1 is arranged near the grip 5. The switch 1 also includes an operation projection 7 projecting out from a respective switch opening 6 formed on both sides of the tool main body 4. The user is thus able to operate the switch 1 by stretching a thumb or a forefinger of a hand gripping the grip 5 to the operation projection 7.

The tool main body 4 accommodates a motor (not shown) directly coupled to the rotation shaft of the chuck 3, where a lock switch 8 is arranged at the upper part of the switch 1 and a light emitting portion 9 accommodating an LED is arranged at the lower side of the chuck 3. A battery 10 can be removably attached to the grip 5.

Figure 2:
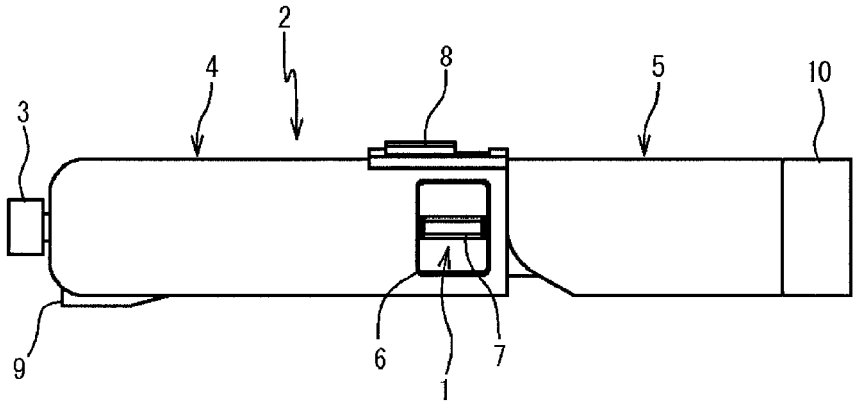
FIG. 2 is a side view of a different usage mode of the electric tool of FIG. 1.

As shown in FIG. 2, the electric tool 2 swings the grip 5 so as to be arranged in a straight line with the back part of the main body 4.

Figure 3:
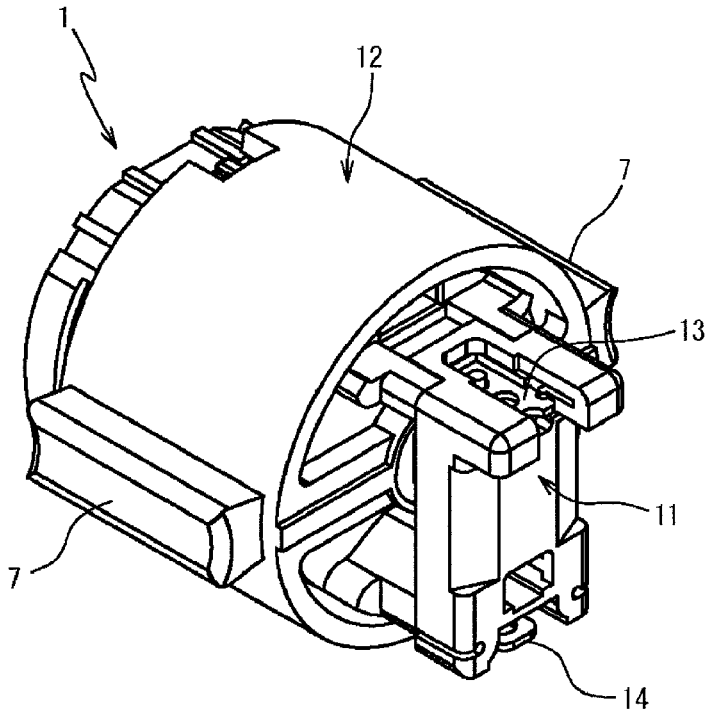
FIG. 3 is a rear perspective view of the switch of FIG. 1.
Figure 4:
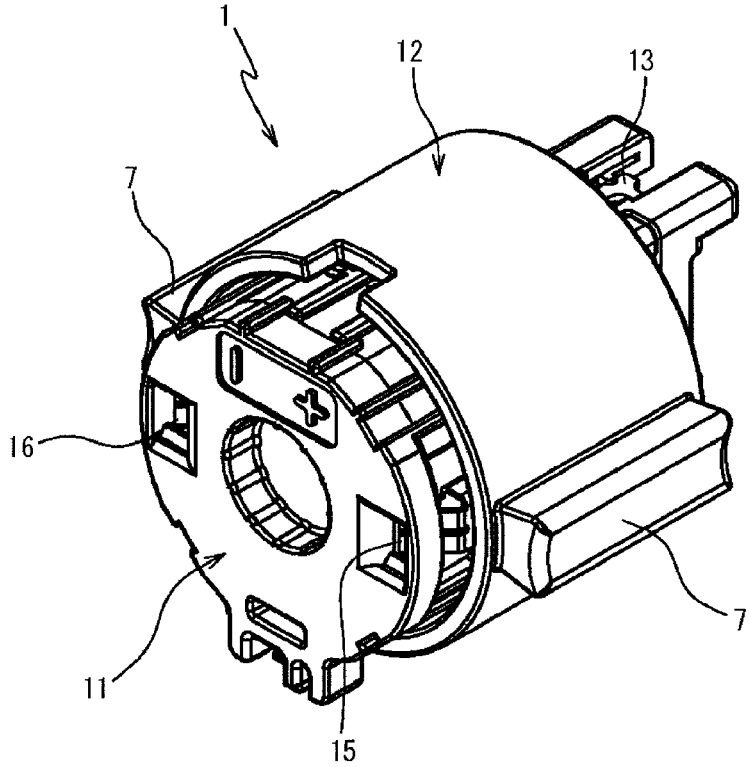
FIG. 4 is a front perspective view of the switch of FIG. 1.

FIGS. 3 and 4 show details of the switch 1. The switch 1 includes a switch main body 11 fixed to the tool main body 4, and a substantially cylindrical operation member 12 turnable by about 30 degrees in both directions about the switch main body 11, and having the operation projection 7 formed on an outer circumferential surface.

The switch main body 11 includes input terminals 13, 14 to be connected to both electrodes of the battery 10, and output terminals 15, 16 to be connected to both electrodes of the motor. The switch 1 is attached to the tool main body 4 such that the turning shaft of the operation member 12 is coaxial with the rotation shaft of the chuck 3.

Figure 5:
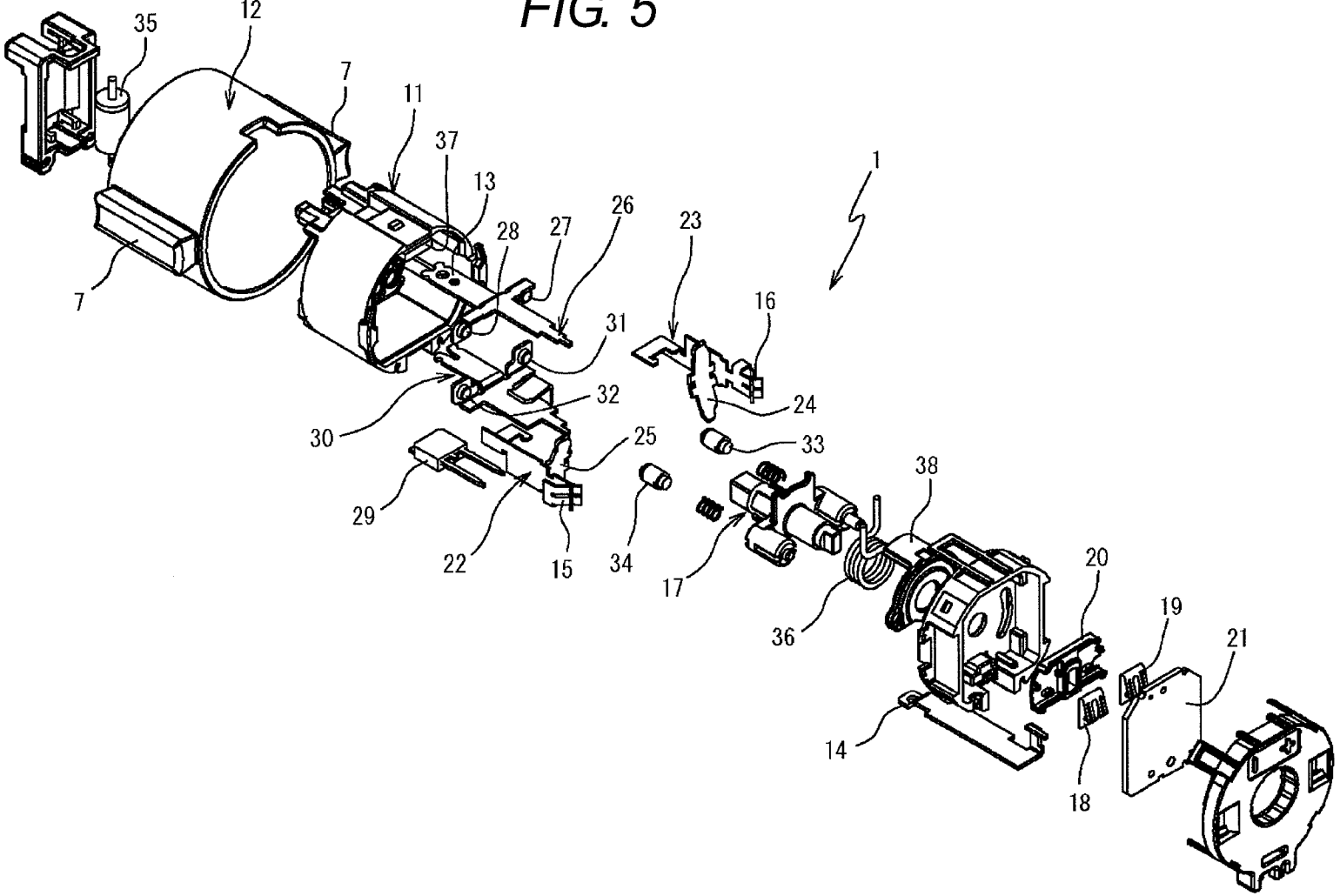
FIG. 5 is an exploded perspective view of the switch of FIG. 1.
Figure 6:
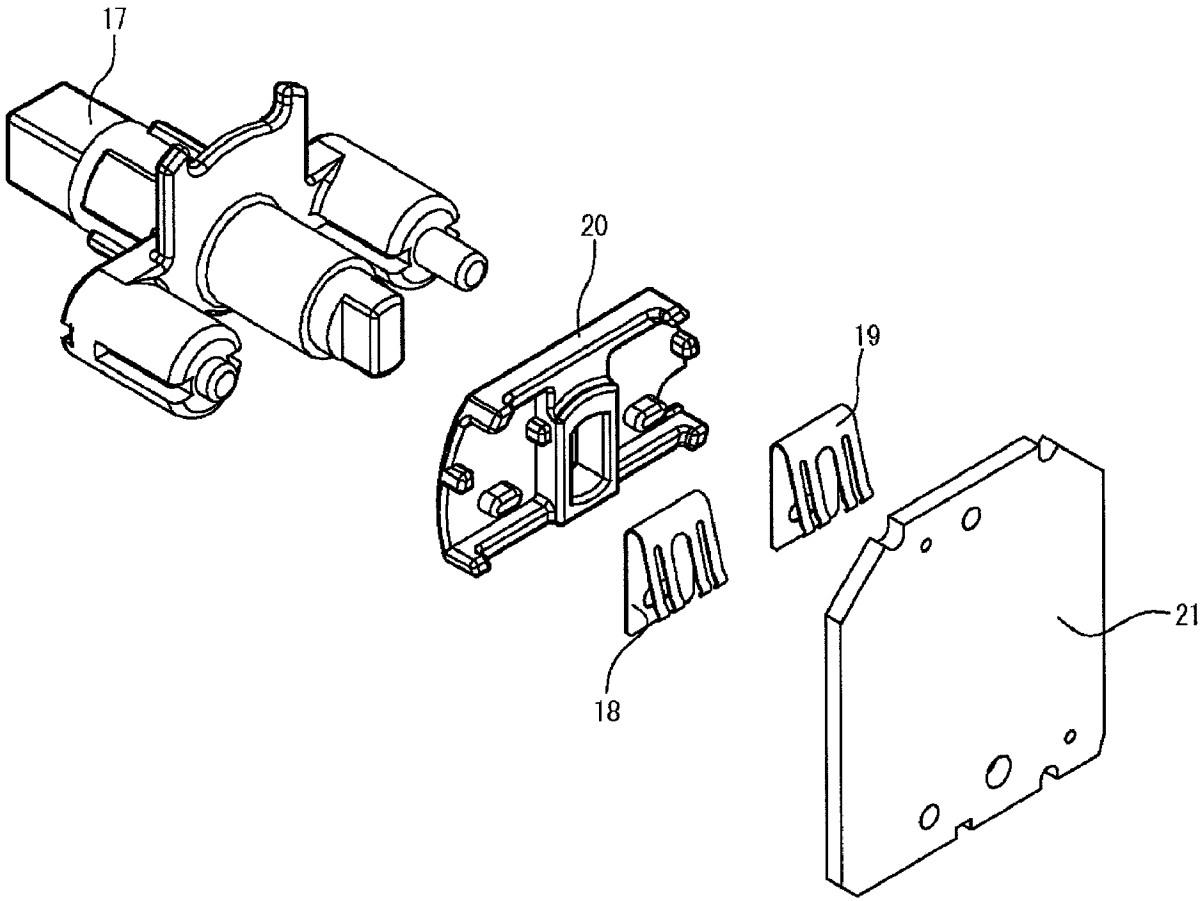
FIG. 6 is an exploded perspective view related to a drive mechanism of a slidably moving element of the switch of FIG. 1.

FIG. 5 shows an exploded perspective view of the switch 1. A shaft member 17 extending coaxially with the turning shaft of the operation member 12 is connected to the interior of the substantially cylindrical switch main body 11, which shaft member 17 turns with the operation member 12. As more specifically shown in FIG. 6, a holding member 20 for holding two slidably moving elements 18, 19 formed by bending a metal plate is attached to the shaft member 17. The slidably moving elements 18, 19 slidably contact a circuit substrate 21 fixed with respect to the switch main body 11 so as to be orthogonal to the turning shaft of the operation member 12.

Figure 7:
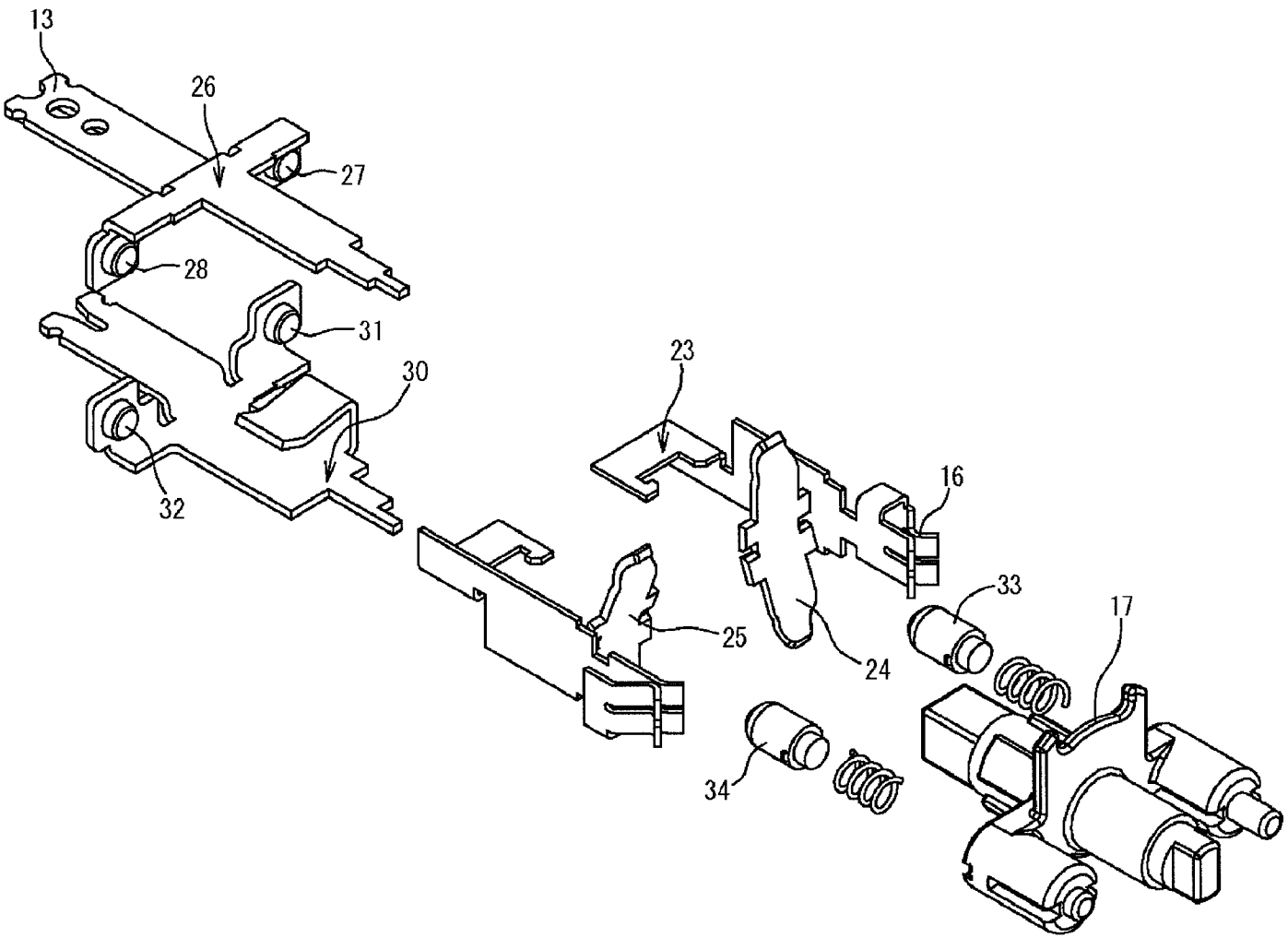
FIG. 7 is an exploded perspective view related to an inversion mechanism of the switch of FIG. 1.

As specifically shown in FIG. 7, the switch 1 includes movable contacts 24, 25 supported in a vibrating manner by electric path members 22, 23 including the output terminals 15, 16. The movable contacts 24, 25 respectively comes into contact with either fixed contacts 27, 28 arranged on an electric path member 26 including the input terminal 13 or fixed contacts 31, 32 arranged on an electric path member 30 connected to a drain terminal of an FET 29 for switching an output to the motor. The shaft member 17 includes drive members 33, 34 spring biased to drive the movable contacts 24, 25.

As shown in FIG. 5, the switch 1 includes a protective diode 35 to prevent a back electromotive force of the motor from being applied to the FET 29. The switch 1 also includes a bias spring 36 for biasing so that an angle of the operation member 12 self-returns to a neutral position where the operation projection 7 is horizontal by way of the shaft member 17.

Figure 8:
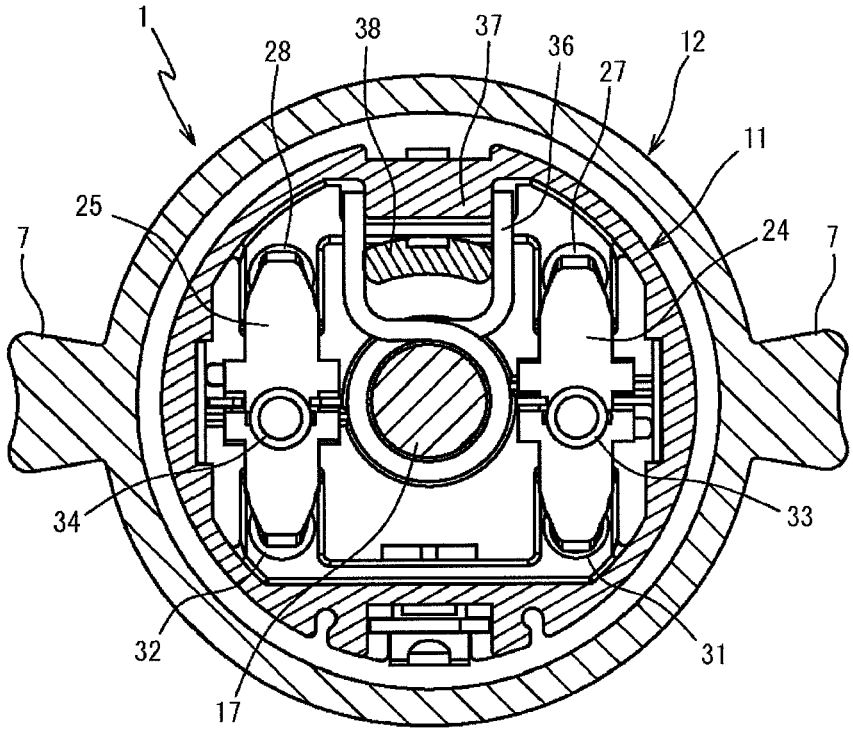
FIG. 8 is a cross-sectional view at a neutral position of the switch of FIG. 1.

As shown in FIG. 8, the bias spring 36 has a central part held by being wrapped around the shaft member 17, and both ends sandwich a lock portion 37 projecting inward from an inner wall of the switch main body 11 from both sides. The bias spring 36 engages the shaft member 17 so as to be positioned between the shaft member 17 and the switch main body 11, and also sandwiches an acting portion 38 that turns with the shaft member 17. The drive members 33, 34 are arranged offset to the fixed contact 31, 32 side, so that the movable contacts 24, 25 connect to the drain of the FET 29 at a neutral position. That is, the motor of the electric tool 2 has both ends short circuited when the operation member 12 is at the neutral position.

Figure 9:
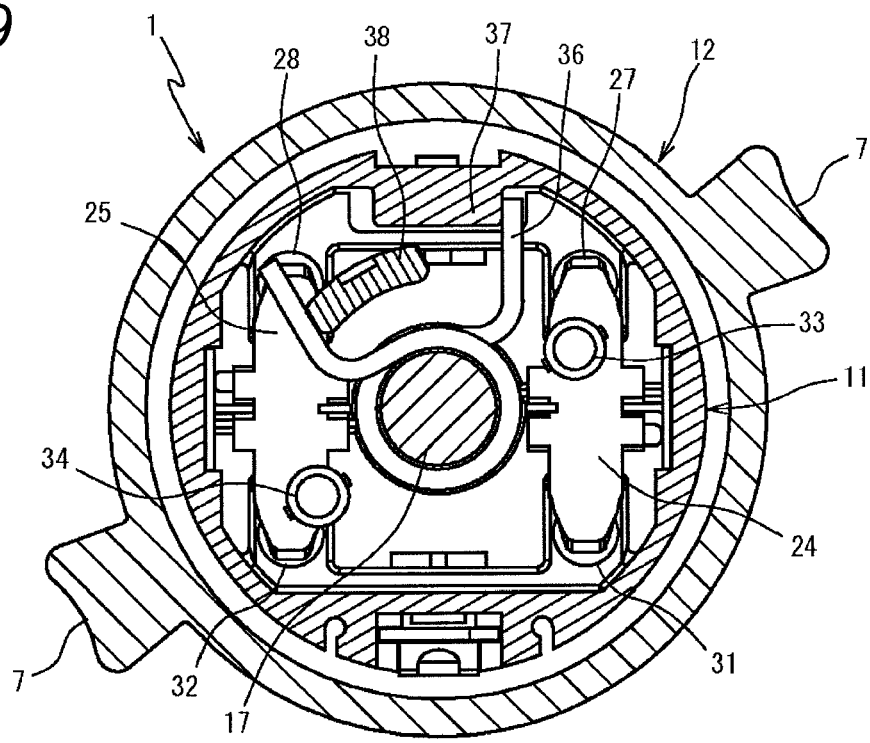
FIG. 9 is a cross-sectional view at a turning position of the switch of FIG. 1.

As shown in FIG. 9, the acting portion 38 turns with the shaft member 17 and the operation member 12 with the turning shaft of the operation member 12 as the center, so that when the user turns the operation member 12, the acting portion 38 turns with respect to the lock portion 37, and elastically deforms so as to separate one end of the bias spring 36 from the other end. With such an elastic force, the bias spring 36 turns the acting portion 38 so as to be in series with the lock portion 37 in a radial direction of the shaft member 17 and returns the operation member 12 to the neutral position.

When the operation member 12 is turned to the right (counterclockwise direction in FIGS. 8 and 9) when seen from the grip 5, the drive members 33, 34 turn as shown in FIG. 9, and brings the movable contact 24 into contact with the fixed contact 27 connected to the battery 10 by way of the input terminal 13. When the operation member 12 is turned to the left, the movable contact 25 comes into contact with the fixed contact 28.

Figure 10:
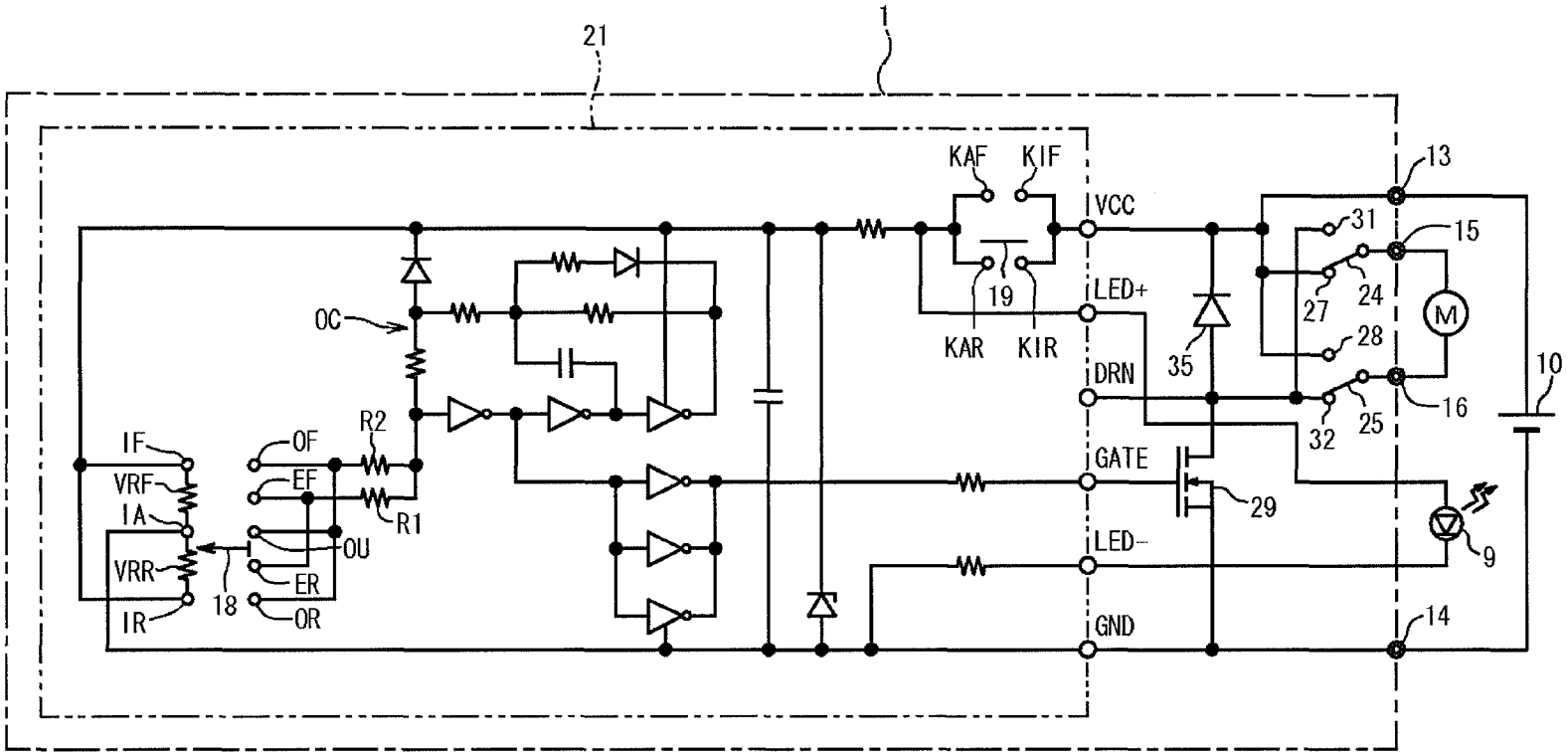
FIG. 10 is a circuit diagram of the electric tool of FIG. 1.

FIG. 10 shows a circuit diagram of the electric tool 2. A range shown with a chain dashed line is a circuit of the switch 1, and a range shown with a chain double-dashed line is a circuit formed on the circuit substrate 21. The battery 10 and the motor are connected to the input terminals 13, 14 and the output terminals 15, 16, but the LED of the light emitting portion 9 has one end soldered to the circuit of the circuit substrate 21 and the other end connected through a pair of lead wires (not shown in FIG. 4) pulled out to the outside of the switch 1.

Figure 11:
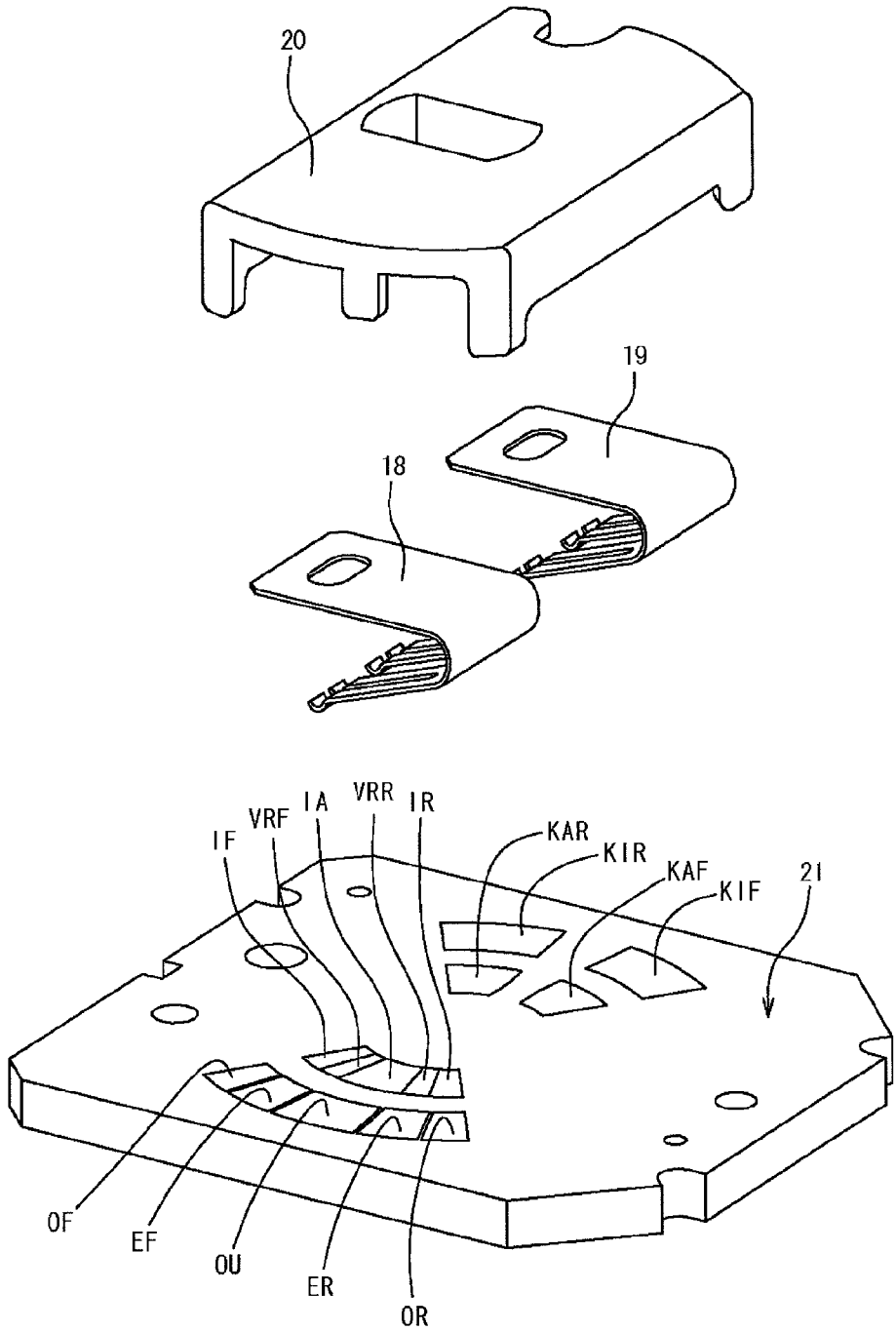
FIG. 11 is an exploded perspective view showing a relationship of a circuit substrate and a slidably moving element of the switch of FIG. 1.

The circuit on the circuit substrate 21 is a speed adjustment circuit that periodically increases or decreases the gate voltage of the FET 29 and varies a ratio of time of outputting the voltage to the motor by controlling the gate voltage. As shown in FIG. 11, the circuit substrate 21 is formed with an electrode and a print resistor that come into contact with the slidably moving elements 18, 19. The slidably moving element 18 is one part of a reference resistor circuit defining the resistance value that determines a current-carrying time ratio of the FET 29, and the slidably moving element 19 is one part of a control power switch that connects or shields the speed adjustment circuit and the battery 10. The slidably moving elements 18, 19 each has two pairs of brush pairs, where two brushes form one pair. The slidably moving elements 18, 19 are held by the holding member 20 such that the contacting position with respect to the circuit substrate 21 of each brush pair is radially in series with the turning shaft of the operation member 12 in between and is lined horizontally when the operation member 12 is at the neutral position.

Figure 12:
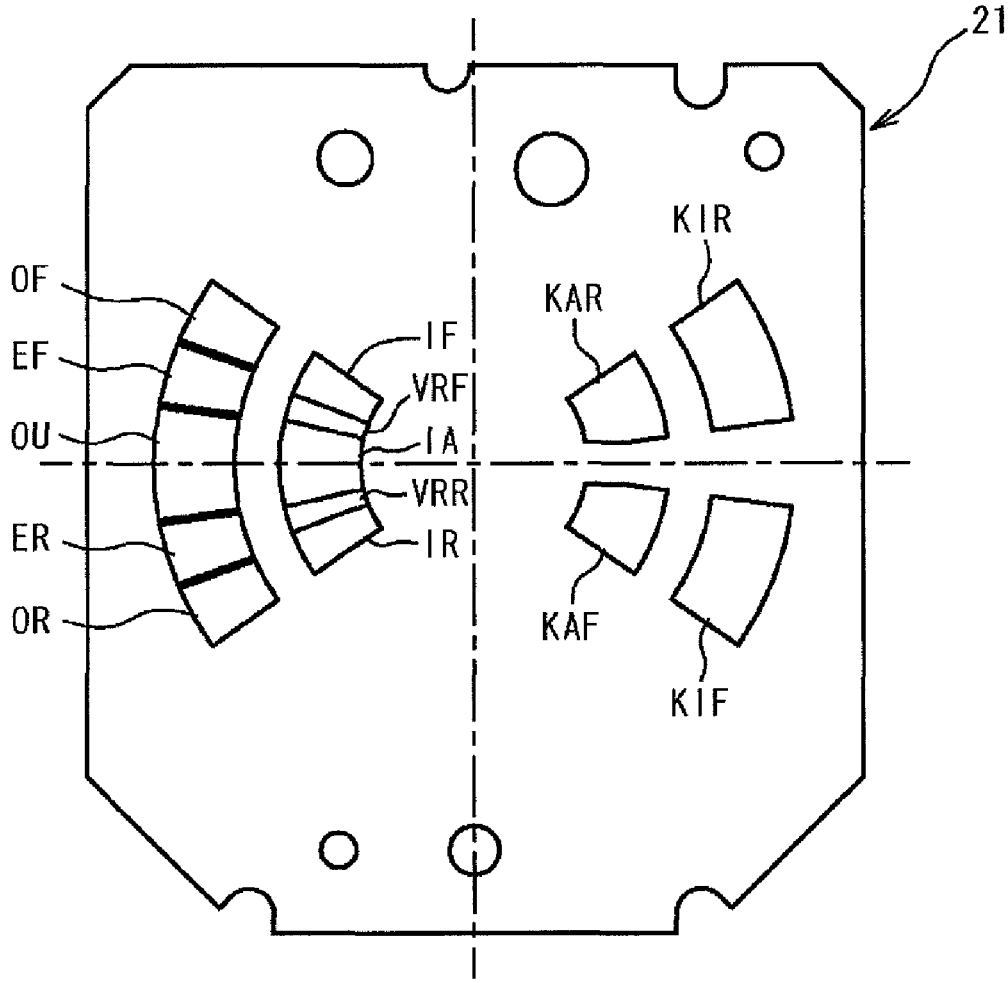
FIG. 12 is a rear view showing an arrangement of an electrode and a print resistor of the circuit substrate of FIG. 11.

FIG. 12 shows the arrangement of the electrode and the print resistor of the circuit substrate 21. One of electrodes IF, IA, IR and print resistors VRF, VRR come into contact with one of the brush pairs of the slidably moving element 18, and one of electrodes OF, EF, OU, ER, OR comes into contact with the other brush pair of the slidably moving element 18. That is, the slidably moving element 18 connects one of the electrodes IF, IA, IR and the print resistors VRF, VRR and one of the electrodes OF, EF, OU, ER, OR.

One brush pair of the slidably moving element 19 comes into contact with an electrode KIF or KIR, and the other brush pair comes into contact with an electrode KAF or KAR. The electrode KIF and the electrode KAF, as well as the electrode KIR and the electrode KAR are respectively formed symmetrically from the neutral position at the same angle when seen from the turning shaft. Specifically, the slidably moving element 19 connects the electrode KIF and the electrode KAF when the operation member 12 is turned by greater than or equal to 8 degrees to the right from the neutral position, and connects the electrode KIR and the electrode KAR when the operation member 12 is turned by greater than or equal to 8 degrees to the left from the neutral position. That is, the power is not supplied to the speed adjustment circuit and the LED of the light emitting portion 9 until the operation member 12 is turned by greater than or equal to 8 degrees to either left or right.

As shown in FIG. 10, the electrode IF and the electrode IR are both connected to the positive electrode of the battery 10, and are respectively connected to the electrode IA connected to the negative electrode of the battery 10 by way of the print resistor VRF or the print resistor VRR. The electrode EF and the electrode ER that can be connected to any place on the print resistor VRF or the print resistor VRR by the slidably moving element 18 are connected to each other.

Therefore, the potentials of the electrode EF and the electrode ER become the potential in which the voltage of the battery 10 is voltage divided by the print resistor VRF or the print resistor VRR. That is, the reference resistor circuit includes two sets of variable resistor circuits that are connected in parallel to each other, and that close the circuit when the slidably moving element 18 slidably contacts and change the voltage dividing ratio of the print resistor VRF or the print resistor VRR, in other words, the resistance value between the battery 10 and the electrodes EF and ER according to the position of the slidably moving element 18.

The two variable resistor circuits are connected to an oscillation circuit OC that generates a gate voltage for periodically switching the FET 29 through a first resistor R1 having a high resistance value. The oscillation circuit OC turns ON the FET 29 at the time ratio set by the voltage dividing ratio (potentials of electrodes EF, ER) of the print resistor VRF or the print resistor VRR.

The electrode OF and the electrode OR are both connected to the electrode OU, and are connected to the oscillation circuit OC through a second resistor R2 having a low resistance value. The oscillation circuit OC outputs a gate voltage that constantly turns ON the FET 29 by applying a potential to the oscillation circuit OC through the second resistor R2.

Figure 13:
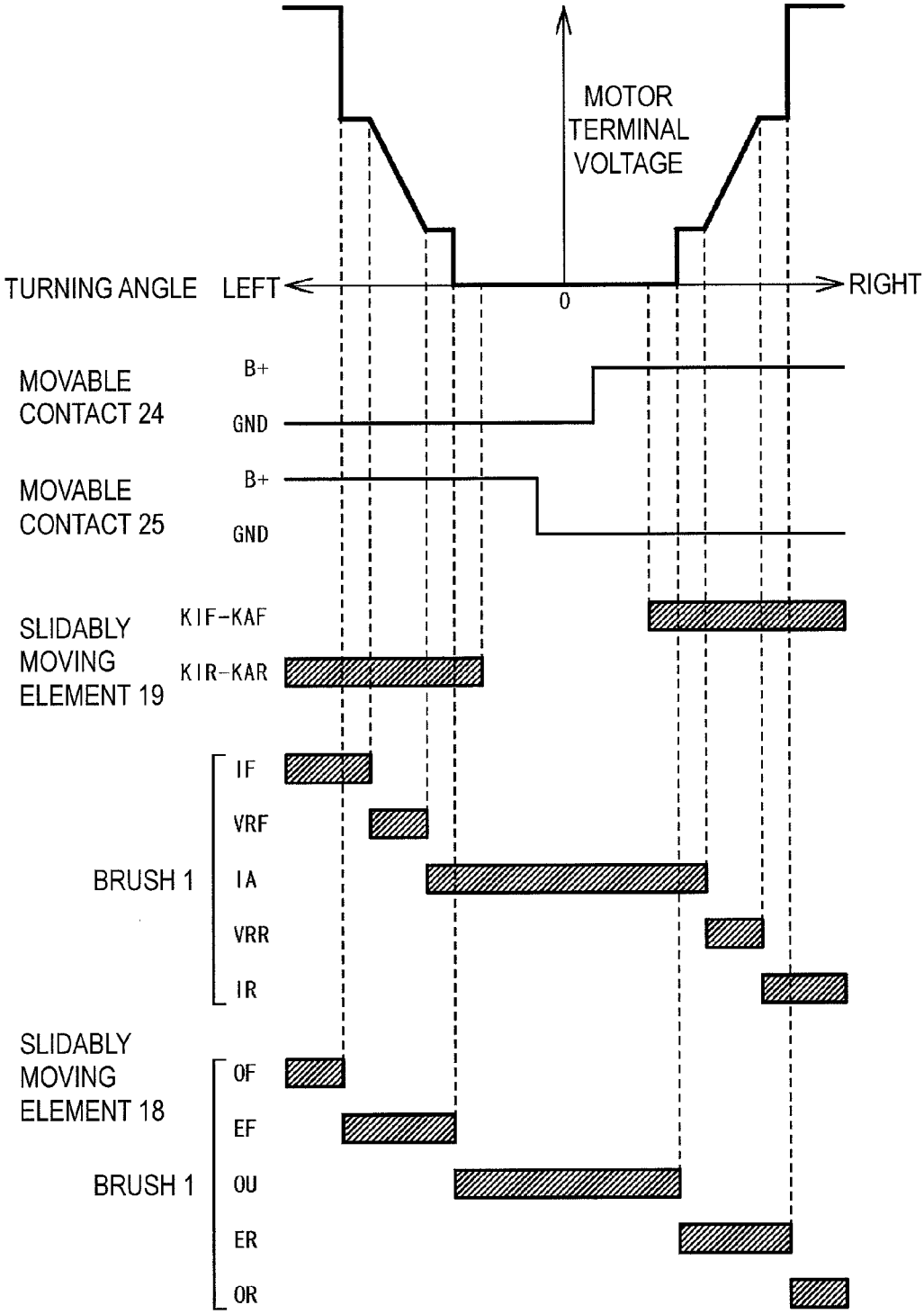
FIG. 13 is a view showing a relationship of a turning angle and a circuit operation of the switch of FIG. 1.

FIG. 13 shows a relationship of the turning angle of the operation member 12 and the state of each switch mechanism. As described above, when the operation member 12 is turned to the right, the movable contact 24 comes into contact with the output electrode 14 connected to one end of the motor to the positive electrode of the battery 10 and rotates the motor to the right. When the operation member is turned to the left, the movable contact 25 connects the output electrode 15 connected to the other end of the motor to the positive electrode of the battery 10 and rotates the motor to the left. That is, the switch 1 includes an inversion mechanism for switching the polarity of the voltage to apply to the motor through the FET 29 according to the turning direction of the operation member 12.

The movable contacts 24, 25 short-circuit both ends of the motor at the neutral position. Thus, when the operation member 12 is returned to the neutral position by the biasing force of the bias spring 36 while the motor is rotating by a force of inertia, a current in an opposite direction flows by a back electromotive force to the wiring of the motor thereby applying brake on the motor.

The slidably moving element 19 connects the battery 10 to the speed adjustment circuit and supplies power before the slidably moving element 18 comes into contact with the electrodes EF, ER. However, when the operation member 12 is near the neutral position, the power supply to the speed adjustment circuit is stopped to prevent wasteful power consumption.

The slidably moving element 18 connects the electrode IA and the electrode OU near the neutral position, inputs 0 V to the oscillation circuit OC, and outputs a gate voltage such that the FET 29 is always turned OFF. In this case, the oscillation circuit OC is connected to a GND through the second resistor R2 having a low resistance value, the electrode OU, the slidably moving element 18, and the electrode IA, and thus the current of the oscillation circuit OC easily flows out and the gate voltage to output is sufficiently lowered.

When the operation member 12 is turned from the neutral position, the slidably moving element 18 first connects the electrode IA to the electrode EF or the electrode ER. The oscillation circuit OC is then connected to the GND through the first resistor R1 having a large resistance value, and thus the current that flows out from the oscillation circuit OC decreases. The oscillation circuit OC thus outputs a gate voltage that slightly turns ON the FET 29.

When the slidably moving element 18 comes into contact with the print resistor VRF or VRR, the output potential of the variable resistor circuit becomes high in proportion to the turning angle of the operation member 12, and the time ratio of turning ON the FET 29 becomes high. The motor thus rotates at a speed proportional to the resistance value (polarization voltage) of the variable resistor circuit (print resistor VRF or VRR).

When the polarization voltage by the variable resistor circuit becomes higher than the voltage of the oscillation circuit OC, the current flows into the oscillation circuit OC through the first resistor R1, and acts to increase the gate voltage. After the slidably moving element 18 reaches the electrode IF or IR, the electrode IF or IR and the electrode OF or OR are connected, and the variable resistor circuit for outputting a terminal voltage of the battery 10 and the oscillation circuit OC are connected through the second resistor having a low resistance value. The current that flows to the oscillation circuit OC through the variable resistor circuit thus becomes sufficiently large, and the FET 29 is constantly turned ON, thereby rotating the motor at a maximum speed.

Therefore, the switch 1 of the present embodiment is used to rotate the distal end tool in the same direction as the turning direction of the operation member 12, and to rotate the distal end tool at the speed corresponding to the turning angle of the operation member 12. Since the distal end tool rotates in the same direction as the turning direction of the operation member 12, the user will not mistake the rotating direction of the distal end tool and another switch does not need to be operated for switching in the rotating direction, whereby the task can be continuously carried out.

The user can intuitively grasp the turning angle of the operation member 12 with the grip 5 and the like as a reference, and thus the rotating speed of the distal end tool can be finely controlled using the switch 1. Furthermore, the user can feel the turning angle of the operation member 12 even by the repulsive force of the bias spring 36, and thus can easily grasp the rotating speed of the distal end tool. In one or more embodiments of the present invention, the rotating speeds of the motor and the chuck 3 refer to the no-load rotating speed, as a general rule, and sometimes differ from the rotating speed at the time of actual load operation.

Figure 14:
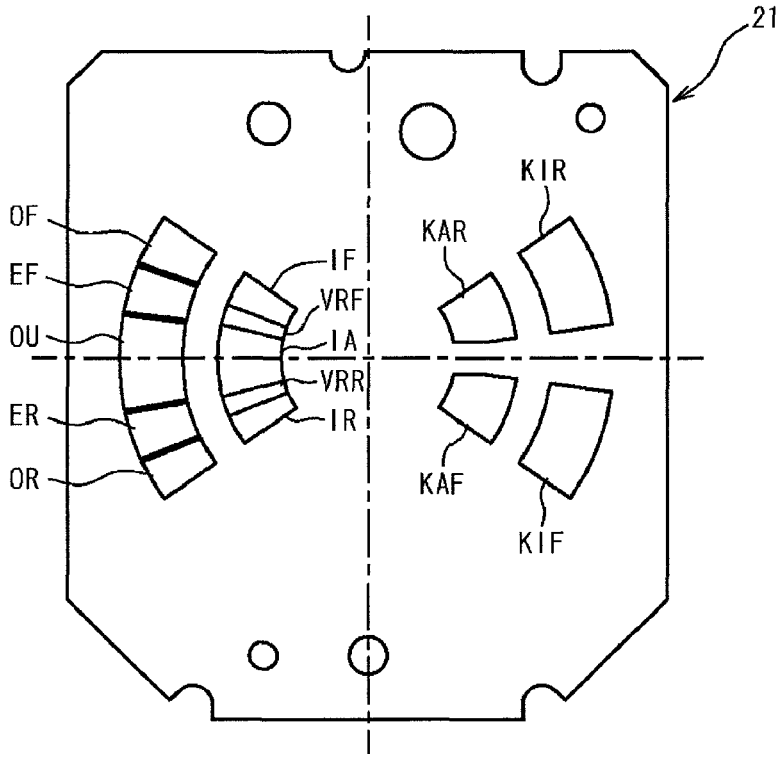
FIG. 14 is a rear view showing an arrangement of an electrode and a print resistor of a circuit substrate of a switch according to a second embodiment of the present invention.

FIG. 14 shows the circuit substrate 21 of the switch 1 according to a second embodiment of the present invention. The present embodiment is the same as the first embodiment other than the arrangement of the electrodes IF, IA, IR and the print resistors VRF, VRR, and thus description thereof will not be repeated. In the switch 1 of the present embodiment, the configuration is the same in the circuit diagram, but the print resistor VFR and the electrode IR are formed distant from the neutral position (greatly turned position) compared to the print resistor VFF and the electrode IF.

Figure 15:
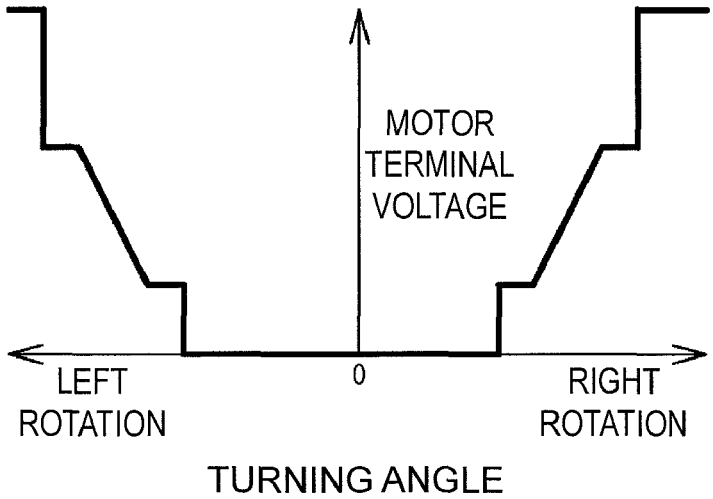
FIG. 15 is a view showing a relationship of a turning angle and a motor terminal voltage of the switch according to the second embodiment of the present invention.

As shown in FIG. 15, in the present embodiment, the operation member 12 needs to be more greatly turned when rotating the motor in a reverse direction compared to when rotating the motor in a forward direction. Thus, when the user rotates the distal end tool in the reverse direction, not only the operation amount becomes larger, but also a larger repulsive force is received from the bias spring 36 than when the distal end tool is rotated in the forward direction, and thus operation with a clear intention is desired.

Figure 16:
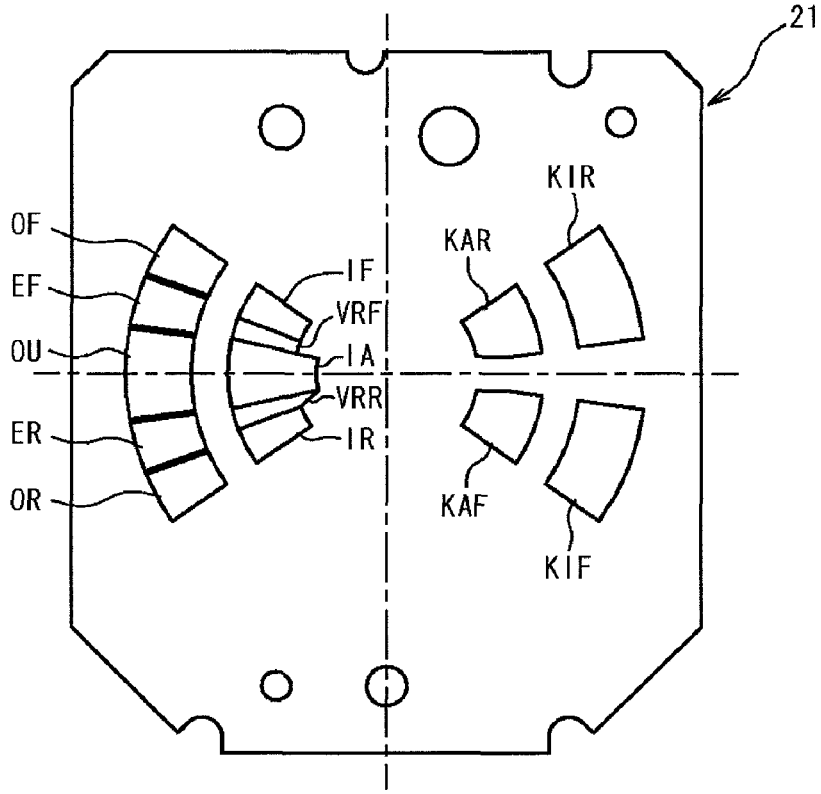
FIG. 16 is a rear view showing an arrangement of an electrode and a print resistor of a circuit substrate of a switch according to a third embodiment of the present invention.

Further, FIG. 16 shows the circuit substrate 21 of the switch 1 according to a third embodiment of the present invention. The present embodiment is the same as the first embodiment other than the arrangement of the electrodes IF, IA, IR and the print resistors VRF, VRR, and thus description thereof will not be repeated. In the present embodiment, the width of the print resistor VFR is larger the closer to the neutral position.

Figure 17:
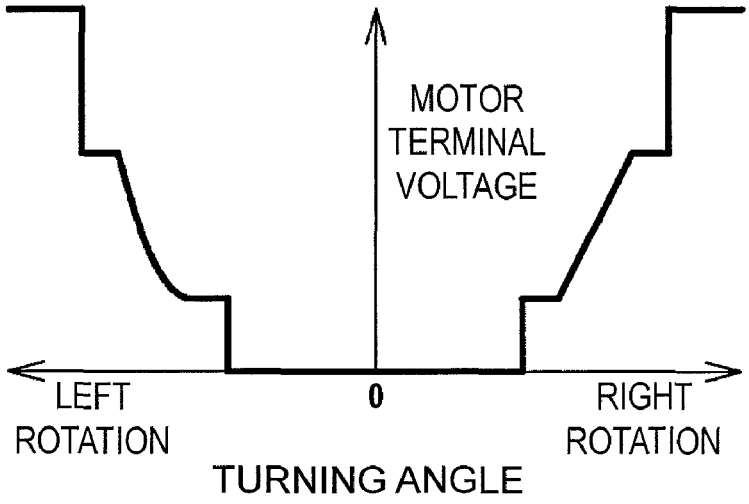
FIG. 17 is a view showing a relationship of a turning angle and a motor terminal voltage of the switch according to the third embodiment of the present invention.

As shown in FIG. 17, in the present embodiment, the smaller the turning angle of the operation member 12 is, the smaller the rate of change in the resistance value between the electrode IA and the slidably moving element 19 with respect to the turning angle of the operation member 12 becomes, and the rate of change in the rotating speed of the motor becomes smaller when turning the operation member 12 to the left. Thus, in the present embodiment, finer speed adjustment can be performed in the low speed region when rotating the distal end tool (chuck 3) in the reverse direction compared to when rotating the distal end tool in the forward direction.

One or more embodiments of the present invention may be used in an electric tool for adjusting the rotating direction and the rotating speed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electric tool switch comprising:

an operation member turnable consecutively in both directions and biased to self-return to a neutral position;

a circuit substrate arranged to be orthogonal to a turning shaft of the operation member;

a pair of slidably moving elements which is pressed against the circuit substrate and which is turned with the operation member to slidably contact the circuit substrate; and an inversion mechanism for switching a polarity between output terminals according to the turning direction of the operation member from the neutral position;

wherein the circuit substrate is formed with two sets of variable resistor circuits, which close a circuit when the slidably moving element slidably contacts and which resistance value changes consecutively according to a contacting position of the slidably moving element, electrically connected in parallel on both sides in the turning direction from a position corresponding to the neutral position of the operation member.

2. The electric tool switch according to claim 1, wherein a change in resistance value with respect to a turning angle of the operation member of two sets of variable resistor circuits is different from each other.

3. The electric tool switch according to claim 1, wherein the inversion mechanism switches the polarity at a position shifted from the neutral position, and short-circuits the output terminals at the neutral position.

4. The electric tool switch according to claim 1, wherein the operation member is formed to a substantially cylindrical shape and is operably arranged at an outer periphery of a switch main body fixed to an electric tool.

5. The electric tool switch according to claim 1, further comprising:

an acting portion, which turns about the turning shaft with the operation member inside the switch main body;

a lock portion which projects inward from an inner wall of the switch main body; and a bias spring, having a central part held at a periphery of the turning shaft and both ends extending to sandwich the acting portion and the lock portion, for turning and biasing so as to have the acting portion in series with the lock portion and the turning shaft.

* * * * *